US008456373B2

(12) United States Patent
Oshima et al.

(10) Patent No.: US 8,456,373 B2
(45) Date of Patent: Jun. 4, 2013

(54) GLASS ANTENNA AND WINDOW GLASS FOR VEHICLE

(75) Inventors: Kiyoshi Oshima, Tokyo (JP); Koji Tabata, Tokyo (JP); Yasuhiro Koga, Tokyo (JP); Kiyoshi Nobuoka, Tokyo (JP); Sotaro Kitade, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 386 days.

(21) Appl. No.: 12/947,507

(22) Filed: Nov. 16, 2010

(65) Prior Publication Data

US 2011/0115681 A1 May 19, 2011

(30) Foreign Application Priority Data

Nov. 17, 2009 (JP) ..... 2009-262187

(51) Int. Cl.
*H01Q 1/32* (2006.01)

(52) U.S. Cl.
USPC ..... 343/713

(58) Field of Classification Search
USPC ..... 343/713, 711
See application file for complete search history.

(56) References Cited

U.S. PATENT DOCUMENTS

| | | | | |
|---|---|---|---|---|
| 4,727,377 | A | 2/1988 | Yotsuya et al. | |
| 6,243,043 | B1 * | 6/2001 | Terashima et al. | 343/713 |
| 7,227,503 | B2 * | 6/2007 | Baba et al. | 343/713 |
| 7,456,796 | B2 * | 11/2008 | Nagayama et al. | 343/713 |
| 7,825,865 | B2 * | 11/2010 | Ibe et al. | 343/713 |
| 2004/0008144 | A1 | 1/2004 | Kubota | |

FOREIGN PATENT DOCUMENTS

| | | |
|---|---|---|
| EP | 0 856 904 A2 | 8/1998 |
| JP | 6-021711 | 1/1994 |
| JP | 2009-212723 A | 9/2009 |

OTHER PUBLICATIONS

Communication (Supplementary EP Search Report) in EP Appln No. 10 01 4702 dated Feb. 21, 2011.

* cited by examiner

*Primary Examiner* — Hoang V Nguyen
(74) *Attorney, Agent, or Firm* — Foley & Lardner LLP

(57) ABSTRACT

A glass antenna for a vehicle on or in a window glass including a defogger having a plurality of heater wires that run in parallel, the glass antenna includes: an antenna conductor; a first feeding portion; and a second feeding portion adjacent to the first feeding portion, wherein: the antenna conductor includes a first antenna conductor, which extends clockwise with the first feeding portion as a starting point, and a second antenna conductor, which extends counterclockwise at the outside of the first antenna conductor with the second feeding portion as a starting point; and the second antenna conductor includes a first element extending between the first antenna conductor and the defogger.

19 Claims, 11 Drawing Sheets

GLASS ANTENNA AND WINDOW GLASS FOR VEHICLE

BACKGROUND

1. Field of the Invention

The present invention relates to a glass antenna for a vehicle in which an antenna conductor and first and second feeding portions adjacent to each other are provided on window glass. In addition, the invention relates to window glass for a vehicle including the glass antenna for a vehicle.

2. Description of the Related Art

As a means for solving a fluctuation (fading) in the receiving level of a radio wave caused by interference between a direct wave and a reflected wave reflected by an obstacle, such as a mountain or a building, for example, a diversity method disclosed in JP-A-6-21711 is known in the related art. The antenna device for a vehicle disclosed in JP-A-6-21711 includes a main antenna, which receives an FM broadcast and outputs an FM main signal, and a sub-antenna, which receives an FM broadcast and outputs an FM sub-signal, on rear window of the vehicle. The FM main signal and the FM sub-signal are mixed in a state having a predetermined phase difference therebetween, and the phase difference is changed so that a sufficient signal level is obtained in signal reception when the mixed level is lower than a predetermined value. That is, the mixed level is changed by adjusting the phase difference at the time of mixing.

In general, received signals of radio waves received through a plurality of antennas become theoretically uncorrelated with each other by ensuring the spatial distance between the antennas according to the wavelength of a radio wave to be received. As a result, it is known that a so-called space diversity effect is obtained. That is, since a correlation coefficient indicating the degree of correlation between an amplitude fluctuation in a received wave received through one antenna and an amplitude fluctuation in a received wave received through another antenna can be reduced according to an increase in the distance between a plurality of antennas, the space diversity effect can be sufficiently realized.

In the case of a glass antenna formed on window glass, however, it is not possible to measure a physical distance between antennas unlike a pole antenna. For this reason, antenna design based on the spatial distance was difficult. Therefore, the inventor of this application discovered that in the case of a glass antenna in which two antenna conductors were provided on window glass for a vehicle, a sufficient space diversity effect could be realized on the glass antenna if a phase difference δ between a received wave received through one antenna conductor and a received wave received through the other antenna conductor was large when a radio wave with a fixed frequency was transmitted. That is, the phase difference δ and the distance between antennas can be considered to be equivalent to each other.

Accordingly, in order to obtain the sufficient space diversity effect demanded, it is necessary to increase the phase difference δ detected as a characteristic of a glass antenna itself by tuning the arrangement position of an antenna conductor, the shape of the antenna conductor itself, and the like. For example, if the arrangement positions of feeding portions of two antenna conductors are distant from each other, the arrangement positions of the two antenna conductors also tend to be distant from each other. In this case, the phase difference δ can be easily increased.

However, depending on the specifications of a vehicle, such as the setting position of a feeding portion or a wiring location, feeding portions of two antenna conductors may have to be brought close to each other. In this case, it is not easy to increase the phase difference δ.

SUMMARY

It is an object of the invention to provide a glass antenna for a vehicle with an antenna characteristic, in which the phase difference between received waves of antenna conductors which form a diversity antenna is large and the gain of each antenna conductor is high even if feeding portions are brought close to each other, and window glass for a vehicle including the glass antenna for a vehicle.

According to an aspect of the invention, there is provided a glass antenna for a vehicle on or in a window glass including a defogger having a plurality of heater wires that run in parallel, the glass antenna including: an antenna conductor; a first feeding portion; and a second feeding portion adjacent to the first feeding portion, wherein: the antenna conductor includes a first antenna conductor, which extends clockwise with the first feeding portion as a starting point, and a second antenna conductor, which extends counterclockwise at the outside of the first antenna conductor with the second feeding portion as a starting point; and the second antenna conductor includes a first element extending between the first antenna conductor and the defogger.

Moreover, in order to achieve the above-described object, window glass for a vehicle according to another aspect of the invention includes the glass antenna for a vehicle.

According to the aspect of the invention, an antenna characteristic is obtained in which the phase difference between received waves of antenna conductors, which form a diversity antenna, is large and the gain of each antenna conductor is high even if feeding portions are brought close to each other.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Hereinafter, embodiments for carrying out the invention will be described with reference to the accompanying drawings. Moreover, in drawings for explaining the embodiments, directions on drawings are referred to if not specifically noted. Moreover, regarding the directions, such as "parallel" and "perpendicular", a deviation which has almost no adverse effect on the effects of the invention is allowed. In addition, these drawings are drawings when viewed facing the surface of window glass, and also drawings when viewed from the inside of the vehicle in a state where the window glass is attached to the vehicle. However, drawings when viewed from the outside of the vehicle may also be referred to. For example, when window glass is rear window attached to the rear of a vehicle, the horizontal direction on drawings is equivalent to a vehicle width direction. In addition, the invention is not limited to the rear window, and may be a windshield attached to the front of a vehicle or side glass attached to the side of the vehicle. Moreover, the window glass for a vehicle according to the embodiment of the invention is preferable in terms of improvement in the antenna gain of a glass antenna if it is window glass in which a defogger with a plurality of heater wires running parallel to each other is provided.

Figure 1:
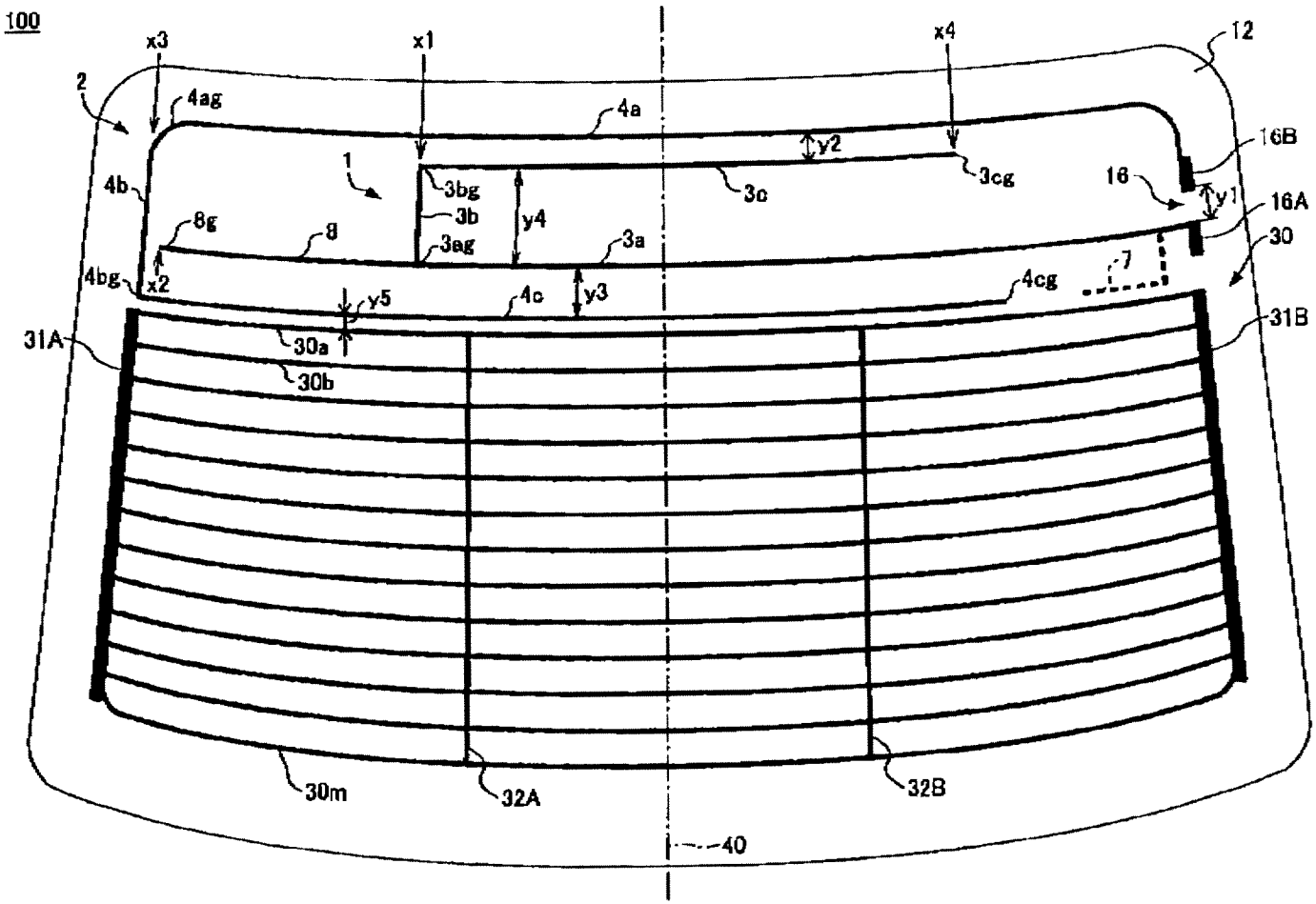
FIG. 1 is a plan view of a glass antenna 100 for a vehicle.

FIG. 1 is a plan view of a glass antenna 100 for a vehicle which is a first embodiment of the invention. The glass antenna 100 for a vehicle is an antenna in which an antenna conductor and first and second feed sections adjacent to each other are provided in a planar manner on window glass 12 in which a defogger 30 with a plurality of heater wires running parallel to each other is provided. The antenna conductor and the first and second feed sections are disposed above the defogger 30.

The defogger 30 has a current heating type pattern with a plurality of heater wires (in FIG. 1, thirteen heater wires 30*a* to 30*m* are shown as an example) running parallel to each other and a plurality of belt-like bus bars (in FIG. 1, two bus bars 31A and 31B are shown as an example) for supplying electric power to the heater wires. The plurality of heater wires is disposed on the window glass 12 so as to run parallel in a direction parallel to the horizontal plane in a state where the window glass 12 is attached to the vehicle, for example. The number of heater wires running parallel to each other may be two or more. A plurality of heater wires running parallel to each other is short-circuited by a shorting line 32A/32B. In addition, the shorting line is used for adjustment of the antenna gain of a glass antenna, and the length is appropriately adjusted. One or two or more shorting lines may be used. In addition, there may be no shorting line. In FIG. 1, at least one bus bar 31A or 31B is provided in each of the left and right regions of the window glass 12. The bus bars 31A and 31B extend in the vertical or approximately vertical direction of the window glass 12.

In addition, the glass antenna 100 for a vehicle includes an antenna conductor 1, which is a first antenna conductor, and an antenna conductor 2, which is a second antenna conductor, as a pattern of an antenna conductor.

The glass antenna 100 for a vehicle is a diversity glass antenna in which the antenna conductor 1 is set as a main antenna conductor and the antenna conductor 2 is set as a sub-antenna conductor. Alternatively, the antenna conductor 1 may be set as a sub-antenna conductor and the antenna conductor 2 may be set as a main antenna conductor. The antenna conductor 1 is an antenna conductor connected to a feeding portion 16A which is a first feeding portion, and the antenna conductor 2 is a second antenna conductor connected to a feeding portion 163 which is a second feeding portion. The antenna conductor 1 is fed from the feeding portion 16A, and the antenna conductor 2 is fed from the feeding portion 16B.

The antenna conductor 1 extends clockwise with the feeding portion 16A as a starting point. The antenna conductor 2 extends counterclockwise at the outside of the antenna conductor 1 with the feeding portion 16B as a starting point. Assuming that one round is formed when the sum of angles bent clockwise or counterclockwise from the feeding portion to the tip of the antenna conductor (subtracted when bent in the opposite direction) is 360°, the antenna conductor 1 may not take one round clockwise and may take (½) round or more. In FIG. 1, the number of rounds of the antenna conductor 1 is a (½) round clockwise. Similarly, the antenna conductor 2 may not take one round counterclockwise and may take (½) round or more. In FIG. 1, the number of rounds of the antenna conductor 2 is a (¾) round counterclockwise.

In addition, although the antenna conductor 2 extends at the outside of the antenna conductor 1 so as to surround the antenna conductor 1, the antenna conductor 2 may not extend so as to surround the entire antenna conductor 1, and the antenna conductor 2 may extend so as to surround a part of the antenna conductor 1.

The antenna conductor 2 includes a first element extending between the antenna conductor 1 and the defogger 30. In FIG. 1, a partial element 4*c* is shown as an example of the first element. The distance between the first element and the defogger 30 is shorter than the distance between the first element and the antenna conductor 1. This is preferable in terms of an improvement in the antenna gain of the antenna conductors 1 and 2. The partial element 4*c* extends between the antenna conductor 1 and the defogger 30 up to the end of the extension of the antenna conductor 2. An end 4*cg* of the extension of the partial element 4*c* is located between the antenna conductor 1 and the defogger 30.

The antenna conductor 1 extends clockwise with the feeding portion 16A as a starting point and the antenna conductor 2 including the first element extends counterclockwise at the outside of the antenna conductor 1 with the feeding portion 16B as a starting point. Accordingly, even if the feeding portions 16A and 16B are brought close to each other, it is possible to obtain an antenna characteristic in which the phase difference between received waves of the antenna conductors 1 and 2, which form the diversity antenna, is large and the gain of each of the antenna conductors 1 and 2 is high.

Subsequently, the antenna conductors 1 and 2 will be described in detail.

The antenna conductor 1 includes second and third elements. The second element extends in a first direction (in FIG. 1, left direction) approximately parallel to the running direction of the plurality of heater wires of the defogger 30. The first direction is a direction approximately parallel to the horizontal plane when the window glass 12 is attached to a vehicle. With the second element as a starting point, the third element extends clockwise up to the end of the extension of the antenna conductor 1 so as to be folded in a second direction (in FIG. 1, right direction) which is an opposite direction to the first direction. In FIG. 1, a partial element 3*a* is shown as an example of the second element, a folded element (3*b* and 3*c*) which is formed by a partial element 3*b* and a partial element 3*c* is shown as an example of the third element.

The partial element 3*a* extends with the feeding portion 16A as a starting point, and extends in the first direction up to an end 3*ag* of the extension in the first direction.

The partial element 3*b* extends in a third direction (in FIG. 1, upper direction), which is a direction becoming close to the upper edge of the window glass 12, with the end 3*ag* of the partial element 3*a* as a starting point.

Figure 3:
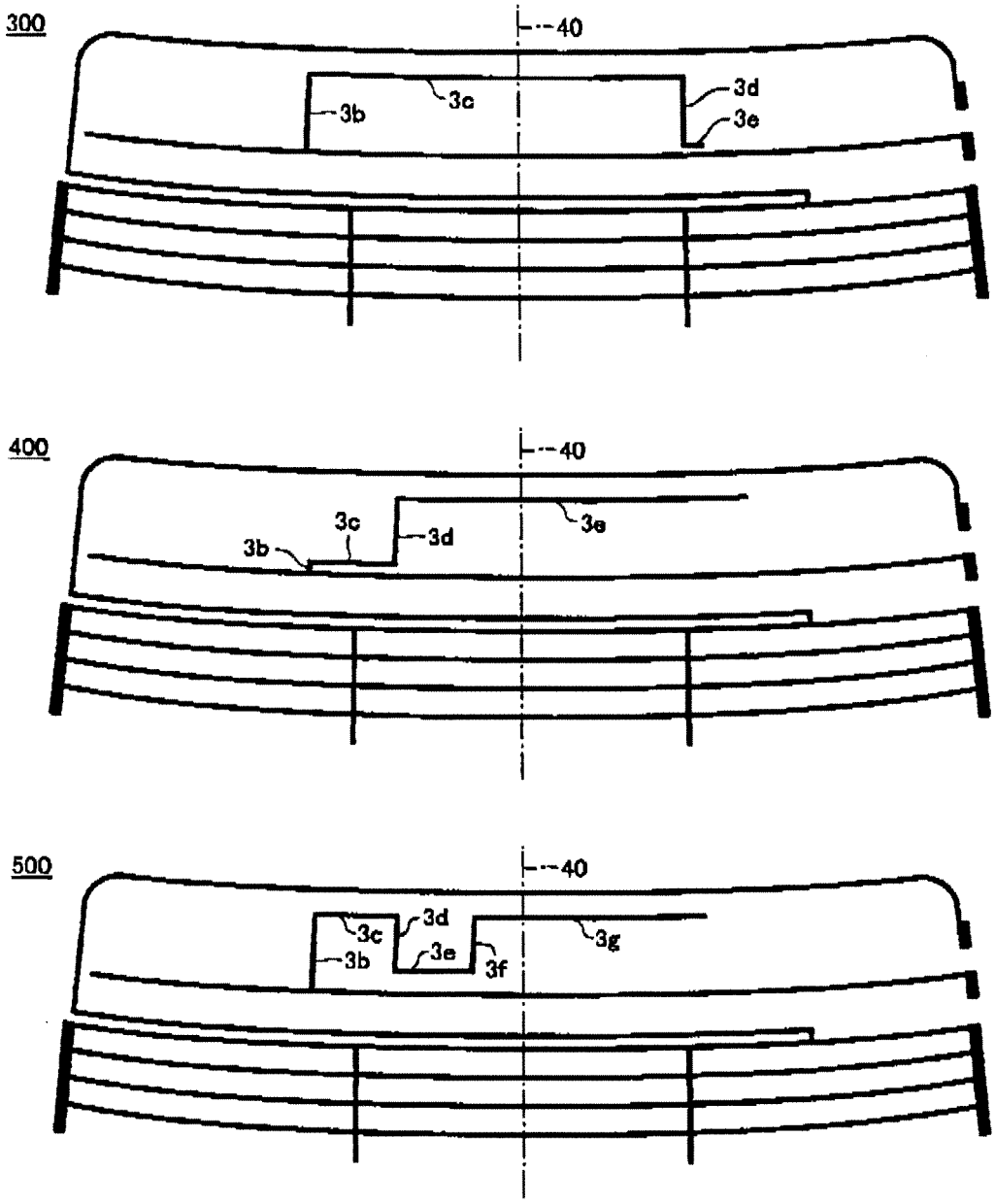
FIG. 3 is a view showing a modification of a folded element (3*b* and 3*c*)

The partial element 3*c* extends in the second direction with an end 3*bg* of the extension of the partial element 3*b* in the third direction as a starting point. The partial element 3*c* extends up to an end 3*cg* of the extension in the second direction. The partial element 3*c* may not extend linearly in the second direction and may have a meandering portion, which extends in the second direction while being bent, as shown in FIG. 3 to be described later.

Moreover, it is preferable that the antenna conductor 1 includes at least one extension element which extends with a point on the antenna conductor 1 as a starting point and is not connected to the antenna conductor 2. By providing such an extension element, the conductor area is increased. As a result, the antenna gain of the antenna conductor 1 in the AM band can be improved. For example, this is suitable for a case where the antenna conductor 1 is used as a common antenna for the FM band and the AM band. In addition, tuning of the antenna gain of the antenna conductor itself or the phase difference can be easily performed by providing such an extension element. The number of extension elements may be increased to two or more.

For example, as indicated by a dotted line in FIG. 1, the antenna conductor 1 may include one extension element 7 extending with a point on the partial element 3*a* as a starting point. The extension element 7 is an L-shaped element which extends in a fourth direction (in FIG. 1, lower direction), which is an opposite direction to the third direction, and then extends in the first direction.

In addition, the antenna conductor 1 may include one extension element extending with a point on the folded element (3*b* and 3*c*) as a starting point. That is, the extension element may extend with a point on the partial element 3*b* as a starting point or may extend with a point on the partial element 3*c* as a starting point. In addition, the antenna gain of the antenna conductor 2 can be improved by providing at least one extension element which extends with the end, which is bent from the first direction of the folded element (3*b* and 3*c*) toward the third direction, as a starting point. In particular, the antenna gain in a low frequency region of the FM band can be improved.

In FIG. 1, one extension element 8 extending in the first direction with the end 3*ag* of the partial element 3*a*, which is an end bent from the first direction of the folded element (3*b* and 3*c*) toward the third direction, as a starting point is shown. The extension element 8 extends in the first direction with the end 3*ag* as a starting point, and extends up to an end 8*g* of the extension in the first direction. The extension element 8 may also be configured to include a plurality of elements extending with a point on the partial element 3*b* as a starting point. In addition, the extension element 8 may further extend in the third direction perpendicular to the first direction.

On the other hand, the antenna conductor 2 includes fourth and fifth elements. In FIG. 1, the fourth element extends in the third direction with the feeding portion 16B as a starting point and then extends in the first direction. The fifth element extends with the fourth element as a starting point and is then bypassed at the first direction side of the element end (in FIG. 1, the end 8*g*) at the first direction side of the antenna conductor 1 so as to be connected to the first element. In FIG. 1, a partial element 4*a* is shown as an example of the fourth element, and a partial element 4*b* is shown as an example of the fifth element.

The partial element 4*a* extends with the feeding portion 16B as a starting point and extends in the first direction. The partial element 4*b* extends in the fourth direction with the end 4*ag* of the extension of the partial element 4*a* in the first direction as a starting point. The partial element 4*c* extends in the second direction with an end 4*bg* of the extension of the partial element 4*b* in the fourth direction as a starting point. The partial element 4*c* extends to the end 4*cg* of the extension in the second direction. The partial element 4*c* extends through a region, which is interposed between the heater wire 30*a* and the antenna conductor 1, along at least either an element end of the antenna conductor 1 at the fourth direction side (in FIG. 1, the partial element 3*a* disposed in the lowermost portion of the antenna conductor 1) or the uppermost heater wire 30*a* of the defogger 30.

Here, the "end" may be an end point of the extension of an antenna element, or may be the vicinity of the end point which is a conductor portion before the end point.

The feeding portion 16A, the antenna conductor 1 connected to the feeding portion 16A, the feeding portion 16B, the antenna conductor 2 connected to the feeding portion 16B, and the defogger 30 are formed by printing paste containing conductive metal, such as silver paste, on the inside surface of a vehicle window glass plate and baking it. However, they are not limited to the forming method described above, and a linear body or a box shaped body made of a conductive material, such as copper, may be formed on the inside surface or outside surface of vehicle window glass, may be bonded to window glass with an adhesive or the like, or may be provided inside the window glass itself.

The glass antenna 100 for a vehicle is a diversity antenna. A received signal of a radio wave received by the antenna conductor 1 is transmitted to a signal processing circuit mounted in a vehicle through a first conductive member electrically connected to the feeding portion 16A equivalent to a power feed point. Similarly, a received signal of a radio wave received by the antenna conductor 2 is transmitted to a signal processing circuit mounted in a vehicle through a second conductive member electrically connected to the feeding portion 16B equivalent to a power feed point.

A feeder line, such as an AV cable or a coaxial cable, is used as a conductive member. When a coaxial cable is used as a feeder line for feeding to the antenna conductor 1 through the feeding portion 16A, it is preferable to electrically connect an inside conductor of the coaxial cable to the feeding portion 16A and ground an outside conductor of the coaxial cable to the vehicle body. In addition, it is also possible to adopt a configuration in which a connector for electrically connecting a conductive member, such as a conductive wire connected to the signal processing circuit, to the feeding portion 16A is mounted in the feeding portion 16A. The same is true for the antenna conductor 2 and the feeding portion 16B.

The shapes of the feeding portions 16A and 16B and the distance between the feeding portions 16A and 16B are preferably decided according to the shape of the mounting surface of the conductive member or the connector and the distance between these mounting surfaces. For example, rectangular or polygonal shapes, such as a square, an approximate square, a rectangle, and an approximate rectangle, are preferable from a point of view of mounting. In addition, circular shapes, such as a circle, an approximate circle, an ellipse, and an approximate ellipse, may also be adopted. In addition, the area of the feeding portion 16A and the area of the feeding portion 16B may be equal or may be different.

In addition, a conductor layer formed of an antenna conductor may be provided inside of a film made of a synthetic resin or on the surface of the film and the film made of a synthetic resin with the conductor layer thereon may be formed on the inside surface or the outside surface of a vehicle window glass plate in order to form a glass antenna. Alternatively, a flexible circuit board formed with an antenna conductor may be formed on the inside surface or the outside surface of a vehicle window glass plate in order to form a glass antenna.

The mounting angle of window glass with respect to a vehicle is 15 to 90°, preferably, 30 to 90° with respect to the horizontal plane.

In addition, it is also possible to form a cover film on the surface of window glass and to provide the entire feeding portion and the entire antenna conductor or their parts on the cover film. Ceramics, such as a black ceramic film, may be mentioned as the cover film. In this case, if window glass is viewed from the outside of the vehicle, a part of the antenna conductor provided on the cover film is not visible from the outside of the vehicle. This leads to window glass excellent in design. In the configuration shown in the drawing, since at least parts of the feeding portion and the antenna conductor are formed on the cover film, only a thin linear portion of the conductor is visible when viewed from the outside of the vehicle. This is preferable in terms of design.

Figure 2:
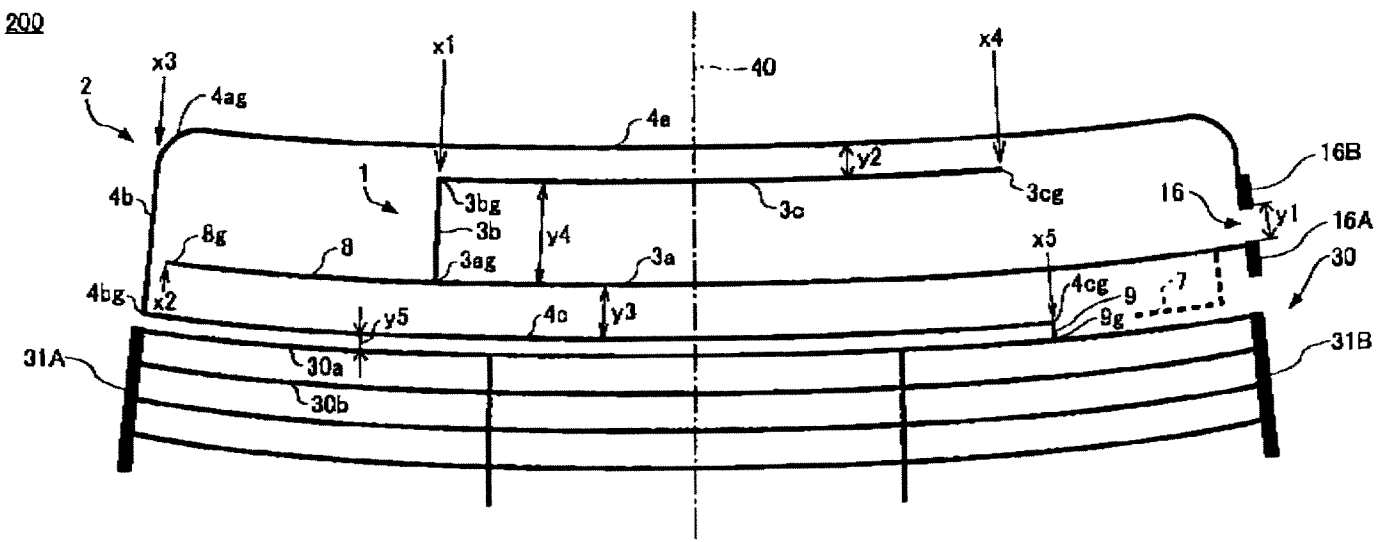
FIG. 2 is a plan view of a glass antenna 200 for a vehicle.

FIG. 2 is a plan view of a glass antenna 200 for a vehicle which is a second embodiment of the invention. The profile of window glass and the lower half of a defogger are not shown in the drawing. Explanations regarding the same sections as in FIG. 1 are omitted.

The antenna conductor 2 includes a connection element 9 for connecting the defogger 30 to a first element (equivalent to the partial element 4*c* in FIG. 2). The connection element 9 connects an end of the extension of the first element (end 4*cg* of the extension of the partial element 4*c* in the second direction) to a connection point 9*g* on the heater wire 30*a*. The connection element 9 may linearly extend in the fourth direction with the end 4*cg* as a starting point, or may be curved to extend in the fourth direction. In addition, an extension element extending in the second direction with the end 4*cg* of the partial element 4*c* as a starting point may be provided.

Meanwhile, in FIGS. 1 and 2, taking into consideration the case of a glass antenna including a branched pattern of the antenna conductor 2, the length xS of a conductor path which connects the feeding portion 16B to the end of the extension of the antenna conductor 2 through the shortest distance may be finely adjusted according to the arrangement position of the feeding portion 16 on the window glass 12. The length xS is equivalent to the conductor length from the feeding portion 16B to the end 4*cg* in the case shown in FIG. 1 and equivalent to the conductor length from the feeding portion 16B to the connection point 9*g* in the case shown in FIG. 2. In the conductor path of the invention, however, for example, when a conductor bypassed in a "U" shape temporarily separated from the extension direction is included in the conductor path of the antenna conductor 2, only a component of the antenna conductor 2 in the extension direction is considered in the conductor path of the "U" shaped portion.

Figure 4:
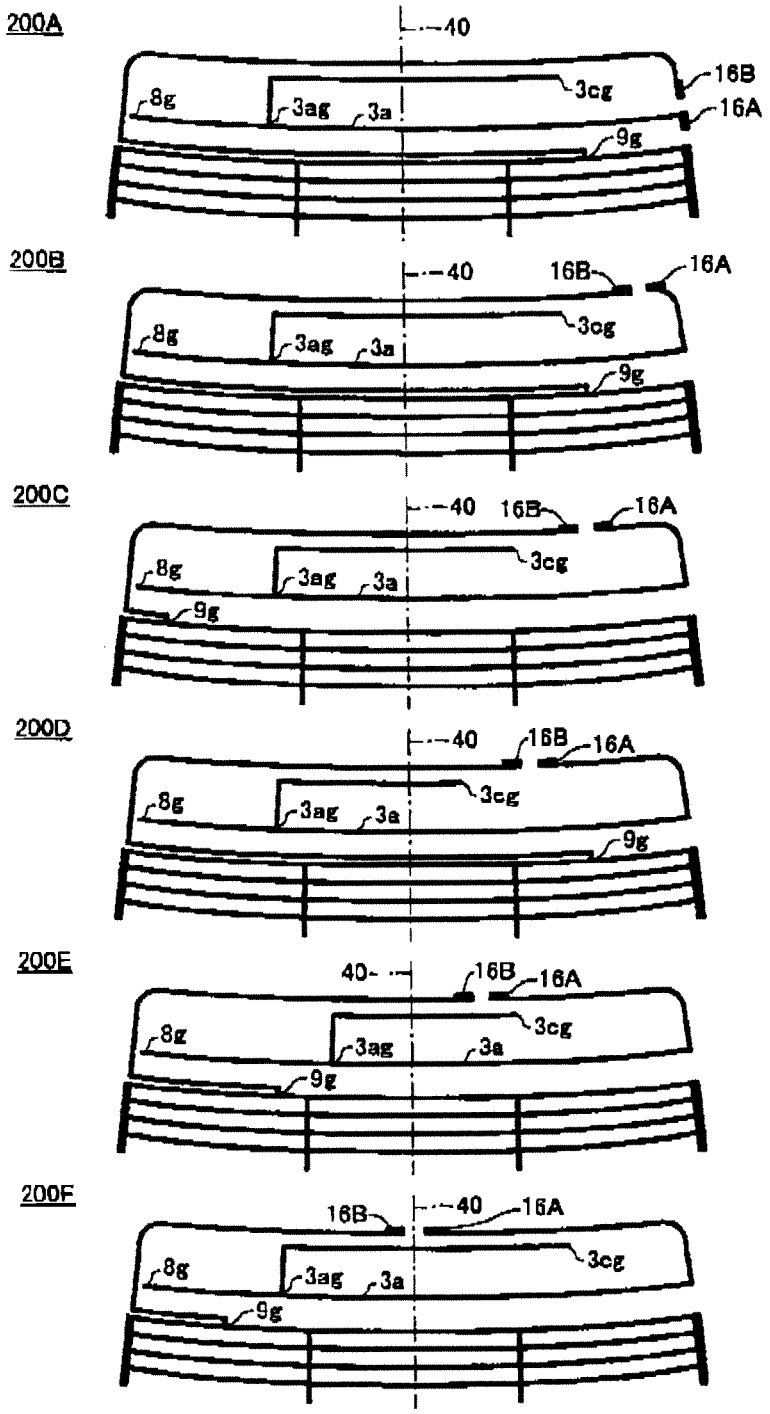
FIG. 4 is an example of the arrangement of a feeding portion 16 on window glass 12.

FIG. 4 is an example of the arrangement of the feeding portion 16 on the window glass 12. The feeding portion 16 is disposed at the edge of the window glass 12 so as to be easily connected to a feeding member at the vehicle side. The feeding portion 16 may be disposed at the upper edge of the window glass 12 or may be disposed at the side edge (right edge or left edge) of the window glass 12. The feeding portions 16A and 16B may be disposed to be close to each other in the vertical direction or may be disposed to be close to each other in the horizontal direction.

In FIG. 4, the arrangement position of the feeding portion 16 is decided according to the shortest distance L from the feeding portion 16B to a centerline 40 of the defogger 30 or the window glass 12. The centerline 40 divides the defogger 30 or the window glass 12 into left and right parts when viewed from the surface of the window glass 12. In this case, it is assumed that the shortest distance L is negative when the position of the feeding portion 16B is at the first direction side (in the drawing, a left side) with respect to the centerline 40 and positive when the position of the feeding portion 16B is at the second direction side (in the drawing, a right side) with respect to the centerline 40. That is, it is assumed that the shortest distance L has a negative value if the position of the feeding portion 16B is at the left side with respect to the centerline 40 when viewed from the surface of the window glass 12 and has a positive value if the position of the feeding portion 16B is at the right side with respect to the centerline 40 when viewed from the surface of the window glass 12.

Meanwhile, in the invention, assuming that the wavelength in the air at the center frequency of a desired broadcast frequency band as a band of a broadcast frequency to be received is $\lambda_0$, the shortening coefficient of wavelength by glass is k (where k=0.64), and $\lambda_g=\lambda_0 \cdot k$, a preferable result in terms of improvement in the antenna gain of the broadcast frequency band can be obtained by adjusting the conductor length of an antenna conductor so that the length xS of a conductor path, which connects the feeding portion 16B to the end of the extension of the antenna conductor 2 through the shortest distance, becomes equal to "$(1/4)\cdot N\lambda_g$". Assuming that n is a natural number, N is set to "2n+1" in the case of the glass antenna 100 for a vehicle which does not include the connection element 9 like the case shown in FIG. 1 and "2n" in the case of the glass antenna 200 for a vehicle which includes the connection element 9 like the case shown in FIG. 2. That is, this means that the same antenna characteristic can be obtained by shifting the length xS by $1/4\lambda_g$ according to whether or not the connection element 9 is present.

For example, when the shortest distance L is equal to or larger than 350 mm (within a range where the feeding portion 16B does not deviate from the window glass 12), a preferable result in terms of improvement in the antenna gain of the broadcast frequency band is obtained if the length xS is equal to or larger than $\{(1/4)\cdot(2n+1)-(8/64)\}\lambda_g$ and equal to or smaller than $\{(1/4)\cdot(2n+1)+(15/64)\}\lambda_g$ in the case of the glass antenna 100 for a vehicle which does not include the connection element 9 and is equal to or larger than $\{(1/4)\cdot 2n-(9/64)\}\lambda_g$ and equal to or smaller than $\{(1/4)\cdot 2n+(15/64)\}\lambda_g$ in the case of the glass antenna 200 for a vehicle which includes the connection element 9, in particular, if the length xS is equal to or larger than $\{(1/4)\cdot(2n+1)-(6/64)\}\lambda_g$ and equal to or smaller than $\{(1/4)\cdot(2n+1)+(13/64)\}\lambda_g$ in the case of the glass antenna 100 for a vehicle which does not include the connection element 9 and is equal to or larger than $\{(1/4)\cdot 2n-(6/64)\}\lambda_g$ and equal to or smaller than $\{(1/4)\cdot 2n+(13/64)\}\lambda_g$ in the case of the glass antenna 200 for a vehicle which includes the connection element 9. Here, n is a natural number (preferably, an integer of 5 or less).

In the case when the shortest distance L is equal to or larger than 250 mm and smaller than 350 mm, assuming that the wavelength in the air at the center frequency of a desired broadcast frequency band as a band of a broadcast frequency to be received is $\lambda_0$, the shortening coefficient of wavelength by glass is k (where k=0.64), and $\lambda_g=\lambda_0 \cdot k$, a preferable result in terms of improvement in the antenna gain of the broadcast frequency band is obtained if the length xS is equal to or larger than $\{(1/4)\cdot(2n+1)-(8/64)\}\lambda_g$ and equal to or smaller than $\{(1/4)\cdot(2n+1)+(11/64)\}\lambda_g$ in the case of the glass antenna 100 for a vehicle which does not include the connection element 9 and is equal to or larger than $\{(1/4)\cdot 2n-(8/64)\}\lambda_g$ and equal to or smaller than $\{(1/4)\cdot 2n+(11/64)\}\lambda_g$ in the case of the glass antenna 200 for a vehicle which includes the connection element 9. Here, n is a natural number (preferably, an integer of 5 or less).

In the case when the shortest distance L is equal to or larger than 150 mm and smaller than 250 mm, assuming that the wavelength in the air at the center frequency of a desired broadcast frequency band as a band of a broadcast frequency to be received is $\lambda_0$, the glass wavelength shortening coefficient is k (where k=0.64), and $\lambda_g=\lambda_0\cdot k$, a preferable result in terms of improvement in the antenna gain of the broadcast frequency band is obtained if the length xS is equal to or larger than $\{(1/4)\cdot(2n+1)-(8/64)\}\lambda_g$ and equal to or smaller than $\{(1/4)\cdot(2n+1)+(9/64)\}\lambda_g$ in the case of the glass antenna 100 for a vehicle which does not include the connection element 9 and is equal to or larger than $\{(1/4)\cdot 2n-(8/64)\}\lambda_g$ and equal to or smaller than $\{(1/4)\cdot 2n+(9/64)\}\lambda_g$ in the case of the glass antenna 200 for a vehicle which includes the connection element 9. Here, n is a natural number (preferably, an integer of 5 or less).

In the case when the shortest distance L is equal to or larger than −150 mm and smaller than 150 mm, assuming that the wavelength in the air at the center frequency of a desired broadcast frequency band as a band of a broadcast frequency to be received is $\lambda_0$, the shortening coefficient of wavelength by glass is k (where k=0.64), and $\lambda_g=\lambda_0\cdot k$, a preferable result in terms of improvement in the antenna gain of the broadcast frequency band is obtained if the length xS is equal to or larger than $\{(1/4)\cdot(2n+1)-(8/64)\}\lambda_g$ and equal to or smaller than $\{(1/4)\cdot(2n+1)+(7/64)\}\lambda_g$ in the case of the glass antenna 100 for a vehicle which does not include the connection element 9 and is equal to or larger than $\{(1/4)\cdot 2n-(8/64)\}\lambda_g$ and equal to or smaller than $\{(1/4)\cdot 2n+(7/64)\}\lambda_g$ in the case of the glass antenna 200 for a vehicle which includes the connection element 9. Here, n is a natural number (preferably, an integer of 5 or less).

Here, the center frequency of an FM broadcast band (76 to 90 MHz) in Japan is 83 MHz, for example. When an FM broadcast band (88 to 108 MHz) in the U.S.A. is set as a received frequency band, the center frequency is 98 MHz. When the Low band (90 to 108 MHz) of a television VHF band is set as a received frequency band, the center frequency is 99 MHz.

Therefore, for example, in order to improve the antenna gain of the FM broadcast band (88 to 108 MHz) in the U.S.A., in the case of the glass antenna 100 for a vehicle which does not include the connection element 9, it is preferable to adjust the length xS to 1200 mm or more and 1700 mm or less (in particular, 1300 mm or more and 1700 mm or less) so as to be equal to $(3/4)\lambda_g$ at the time of "n=1" assuming that the speed of a radio wave is $3.0\times10^8$ m/s. Alternatively, it is preferable to adjust the length xS to 2200 mm or more and 2700 mm or less (in particular, 2300 mm or more and 2700 mm or less) so as to be equal to $(5/4)\lambda_g$ at the time of "n=2".

Moreover, in the case of the glass antenna 200 for a vehicle which includes the connection element 9, it is preferable to adjust the length xS to 700 mm or more and 1200 mm or less (in particular, 800 mm or more and 1200 mm or less) so as to be equal to $(2/4)\lambda_g$ at the time of "n=1". Alternatively, it is preferable to adjust the length xS to 1700 mm or more and 2200 mm or less (in particular, 1800 mm or more and 2200 mm or less) so as to be equal to $(4/4)\lambda_g$ at the time of "n=2".

By performing the adjustment as described above, a preferable result in terms of improvement in the antenna gain can be obtained without having to consider the arrangement position of the feeding portion 16 described above.

FIG. 3 is a view showing a modification of the folded element (3*b* and 3*c*). The folded element (3*b* and 3*c*) has a meandering portion which extends while meandering in the second direction. In the case of a glass antenna 300 for a vehicle, a folded element includes partial elements 3*b* to 3*e*. In the case of a glass antenna 400 for a vehicle, a folded element includes partial elements 3*b* to 3*e*. In the case of a glass antenna 500 for a vehicle, a folded element includes partial elements 3*b* to 3*g*.

In the invention, assuming that the wavelength in the air at the center frequency of a desired broadcast frequency band as a band of a broadcast frequency to be received is $\lambda_0$, the shortening coefficient of wavelength by glass is k (where k=0.64), and $\lambda_g=\lambda_0\cdot k$, a preferable result in terms of improvement in the antenna gain of the broadcast frequency band is obtained if the conductor length xC of the folded element (3*b* and 3*c*) is equal to or larger than $(12/64)\lambda_g$ and equal to or smaller than $(32/64)\lambda_g$, in particular, if the conductor length xC of the folded element (3*b* and 3*c*) is equal to or larger than $(15/64)\lambda_g$ and equal to or smaller than $(29/64)\lambda_g$.

Therefore, for example, in order to improve the antenna gain of the FM broadcast band (88 to 108 MHz) in the U.S.A., it is preferable to adjust the conductor length xC to 350 mm or more and 950 mm or less (in particular, 450 mm or more and 850 mm or less) assuming that the speed of a radio wave is $3.0\times10^8$ m/s.

EXAMPLES

Actual measurement results of the antenna gain and the phase characteristic of glass antennas for vehicles manufactured by attaching the glass antennas shown in FIGS. 1, 2, 4, and 5 to rear window of an actual vehicle will be described.

The antenna gain and the phase characteristic are measured after assembling window glass for a vehicle, which is formed with a glass antenna, on the window frame of a vehicle on a turntable in a state being inclined by 20° with respect to the horizontal plane. A connector is attached to the feeding portion, and the connector is connected to an amplifier. The amplifier is an amplifier with a gain of 8 dB. In addition, the amplifier is connected with a tuner through a feeder line (1.5 C-2V 4.5 m). The turntable rotates so that radio waves from all directions (polarized waves when the polarization plane of a frequency of 88 to 108 MHz is inclined by 45° from the horizontal plane) are irradiated to the window glass from the horizontal direction.

Measurement of the antenna gain and the phase difference is performed by rotating the vehicle by 360° in a state where the vehicle center of the vehicle assembled with glass of the glass antenna is set at the center of the turntable. Data of the antenna gain and the phase difference is measured every megahertz in the irradiation frequency band of 88 to 108 MHz, for every angle of rotation of 5°. The angle of elevation between the transmission position of a radio wave and an antenna conductor was measured in the approximately horizontal direction (direction corresponding to the angle of elevation of 0° when it is assumed that a plane parallel to the ground corresponds to the angle of elevation=0° and the zenith direction corresponds to the angle of elevation=90°).

Figure 5:
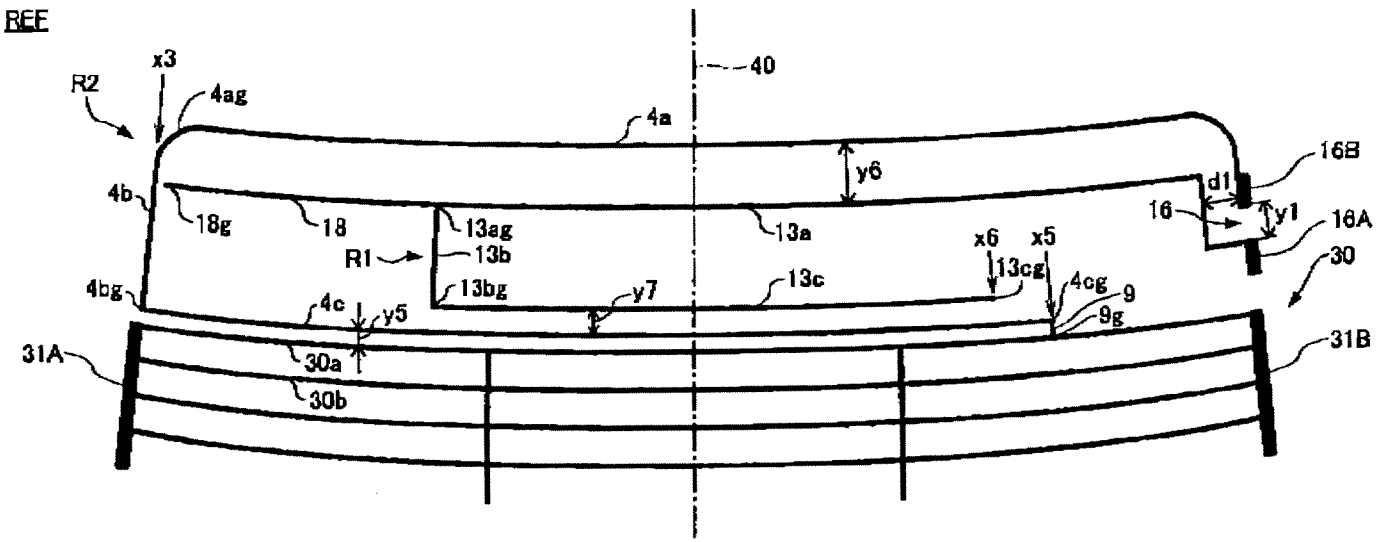
FIG. 5 is a plan view of a glass antenna REF for a vehicle.

FIG. 5 is a plan view of a glass antenna REF for a vehicle which is compared with the glass antenna for a vehicle which is an embodiment of the invention. The glass antenna REF for a vehicle is also a diversity glass antenna, similar to the glass antenna for a vehicle which is an embodiment of the invention.

An antenna conductor R1 extends counterclockwise with the feeding portion 16A as a starting point. An antenna conductor R2 extends counterclockwise at the outside of the antenna conductor R1 with the feeding portion 16B as a starting point. A partial element 13*a* extends with the feeding portion 16A as a starting point and then extends in the first direction up to an end 13*ag* of the extension in the first direction. A partial element 13*b* extends in the fourth direction, which is a direction becoming close to the middle of the window glass 12, with the end 13*ag* of the partial element 13*a* as a starting point. A partial element 13*c* extends in the second direction with an end 13*bg* of the extension of the partial element 13*b* in the fourth direction as a starting point. The partial element 13*c* extends up to an end 13*cg* of the extension in the second direction. Moreover, an extension element 18 extends up to an end 18*g* in the first direction with the end 13*ag* of the partial element 13*a* as a starting point.

That is, the antenna conductor R1 of the glass antenna REF for a vehicle which is located inside the antenna conductor R2 extends counterclockwise, while the antenna conductor 1 of the glass antenna 200 for a vehicle which is located inside the antenna conductor 2 extends clockwise.

Figure 6A:
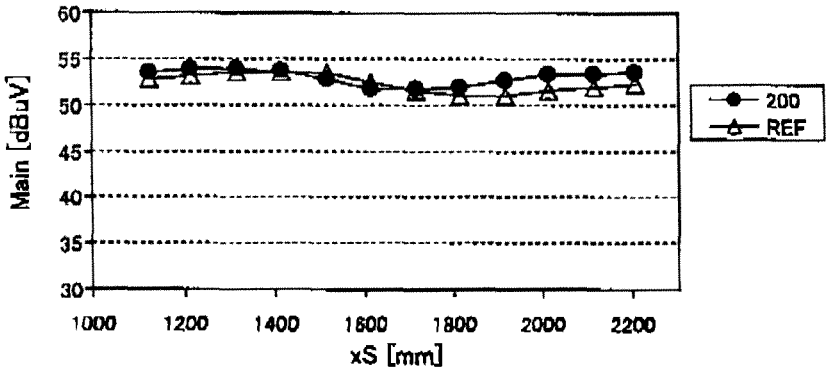
FIGS. 6A to 6C show the measurement data regarding the antenna gain and the phase difference when changing the conductor length xS in the glass antenna REF and the glass antenna 200.
Figure 6B:
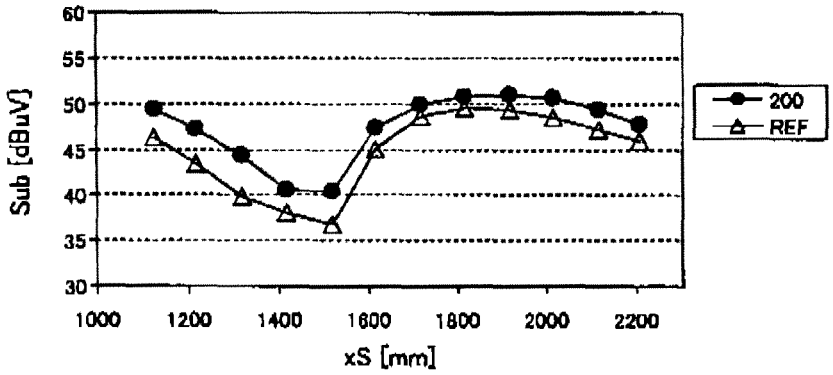
Figure 6C:
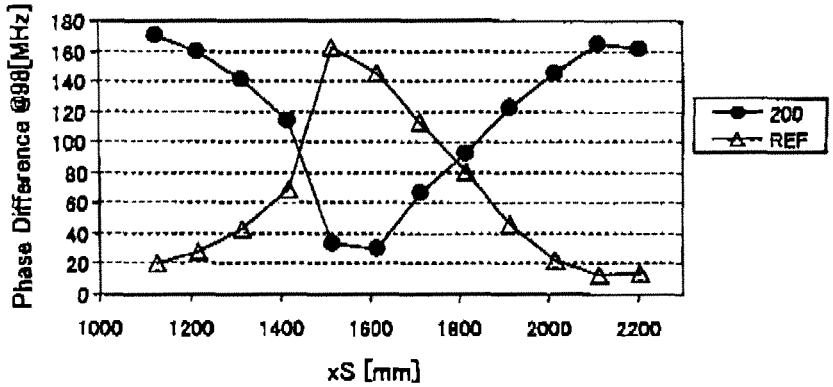

FIGS. 6A to 6C show the measurement data regarding the antenna gain and the phase difference when changing the length xS in high-frequency glass antennas for vehicles manufactured by attaching the glass antennas 200 and REF shown in FIGS. 2 and 5 to rear window of an actual vehicle.

In FIG. 6A, the vertical axis indicates the average value of antenna gains of a first antenna conductor (main antenna) measured every megahertz in the irradiation frequency band of 88 to 108 MHz. In FIG. 6B, the vertical axis indicates the average value of antenna gains of a second antenna conductor (sub-antenna) measured every megahertz in the irradiation frequency band of 88 to 108 MHz. In FIG. 6C, the vertical axis indicates the average value obtained by averaging the absolute values of the phase differences, which are measured every angle of rotation of 1° at the irradiation frequency of 98 MHz, by 360° in the Azimuth direction regarding received waves received by the antenna conductor 1 (R1) and the antenna conductor 2 (R2).

The size of each section of each glass antenna measured in FIGS. 6A to 6C is as follows assuming that the unit is mm.

xF: 785
xC: 650
xB: 260
x1: 250
x2: 510
x3: 530
x4: 300
x5: 350
x6: 300
y1: 40
y2: 20
y3: 60
y4: 100
y5: 10
y6: 50
y7: 30
d1: 30

The size of the defogger 30 (vertical×horizontal): 420 mm×1080 mm. Here, it is assumed that the conductor length which connects the feeding portion 16A to the end 3*ag* (13*ag*) is xF, the conductor length of the folded element (3*b* and 3*c*) is xC, and the conductor length of the extension element 8 (18) is xB. In addition, "x" ( indicates a number) indicates the shortest distance from a point, which "x" indicates by the arrow in FIGS. 2 and 5, to the centerline 40 of the defogger 30. The centerline 40 is a straight line virtually drawn in the vertical direction. "y" indicates a shortest distance between conductors in the vertical direction.

In addition, the conductor width of each antenna conductor is 0.8 mm. In addition, the sizes of the feeding portions 16A and 16B are the same. In addition, the bus bar 31A is connected to the vehicle body earth through an FM coil (not shown), and the bus bar 31B is connected to an anode of a DC power supply through an FM coil (not shown).

As shown in FIGS. 6B and 6C, the gains and the phase differences of the antenna conductors 2 and R2, which are sub-elements, change with a change in the length xS. In particular, as shown in FIG. 6C, if the glass antenna 200 with the clockwise antenna conductor 1 is compared with the glass antenna REF with the counterclockwise antenna conductor R1, the directions (waveforms) of a change in the phase difference between the antenna conductors over the length xS are inverted.

In the case of the glass antenna REF, the phase difference can be increased by adjusting xS to an appropriate value. However, at the length xS when the phase difference is large, the gain of a sub-element is reduced. On the other hand, in the case of the glass antenna 200, a reduction in the gain of the sub-element is suppressed even at the length xS when the phase difference is large. That is, according to FIG. 6, it can be seen that the antenna conductor 1 located inside the antenna conductor 2 needs to extend clockwise.

Figure 7A:
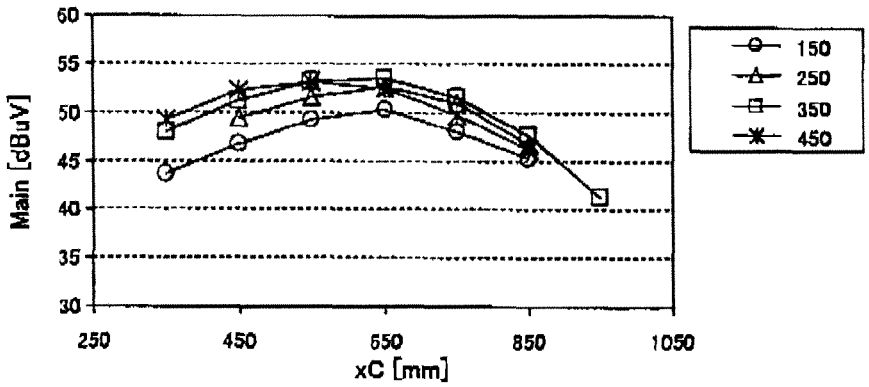
FIGS. 7A to 7C show the measurement data regarding the antenna gain and the phase difference when changing the conductor length xC.
Figure 7B:
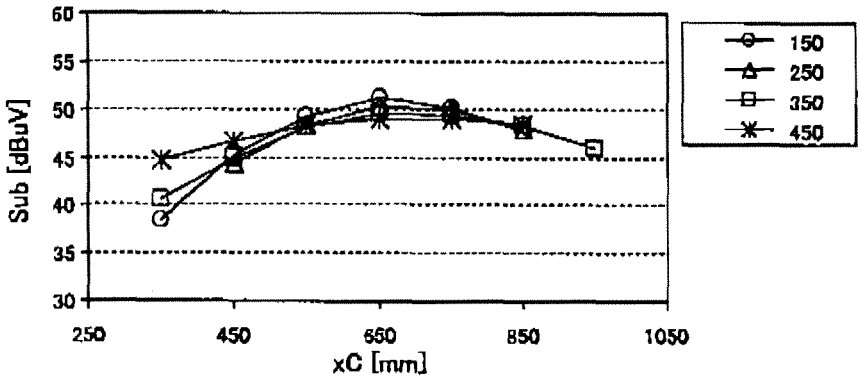
Figure 7C:
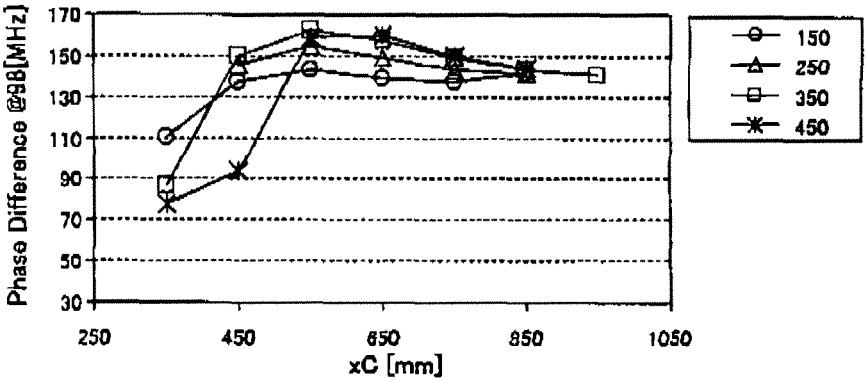

FIGS. 7A to 7C show the measurement data regarding the antenna gain and the phase difference when changing the conductor length xC of the folded element (3*b* and 3*c*) in a high-frequency glass antenna for a vehicle manufactured by attaching the glass antenna 200 shown in FIG. 2 to rear window of an actual vehicle. FIGS. 7A to 7C show the data measured for four kinds of x1, that is, when x1 is "150 mm", "250 mm", "350 mm", and "450 mm". Measuring conditions and meaning of the vertical axis are the same as those in FIGS. 6A and 6B.

Therefore, as shown in FIGS. 7A to 7C, if xC is equal to or larger than 350 mm and equal to or smaller than 950 mm, it is possible to ensure the phase difference between the antenna conductors 1 and 2 of about 70° or more and to improve the antenna gains of the antenna conductors 1 and 2. In particular, if xC is equal to or larger than 450 mm and equal to or smaller than 850 mm, it is possible to ensure the phase difference between the antenna conductors 1 and 2 of about 90° or more and to improve the antenna gains of the antenna conductors 1 and 2.

Figure 8A:
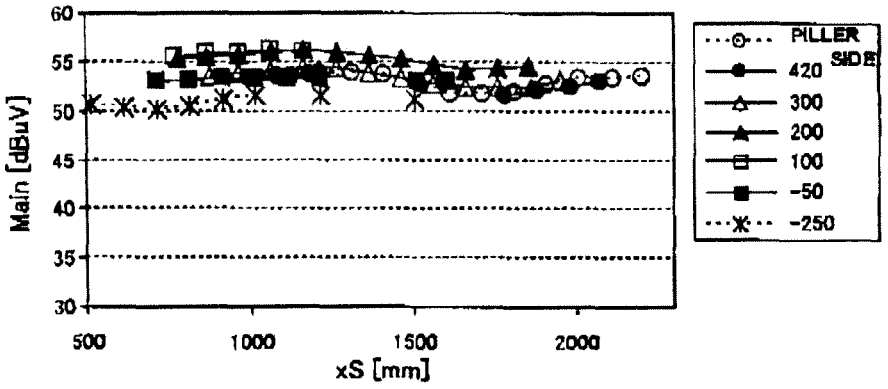
FIGS. 8A to 8C show the measurement data regarding the antenna gain and the phase difference when changing the conductor length xS.
Figure 8B:
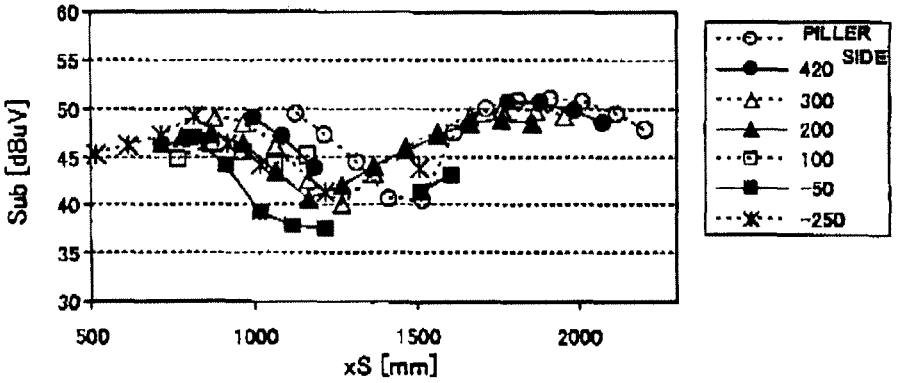
Figure 8C:
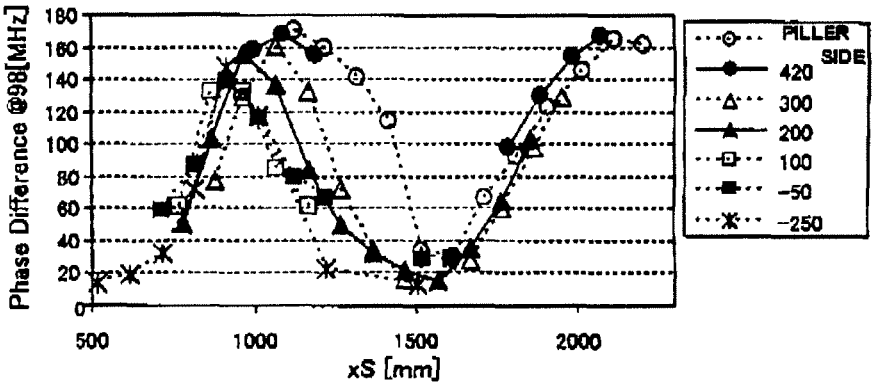

FIGS. 8A to 8C show the measurement data regarding the antenna gain and the phase difference when changing the length xS in a high-frequency glass antenna for a vehicle manufactured by attaching each of the glass antennas 200A to 200F shown in FIG. 4 to rear window of an actual vehicle. FIGS. 5A to 8C show the data measured for seven kinds of shortest distance L, that is, when the shortest distance L is "520 mm (case of the glass antenna 200A in which a feeding portion is located at the pillar side)", "420 mm (case of the glass antenna 200B)", "300 mm (case of the glass antenna 200C)", "200 mm (case of the glass antenna 200D)", "100 mm (case of the glass antenna 200E)", "−50 mm (case of the glass antenna 200F)", and "−250 mm". Measuring conditions and meaning of the vertical axis are the same as those in FIGS. 6A and 6B.

According to FIGS. 8A to 8C, in the case of the glass antenna 200, the antenna gain of the antenna conductor 2 which is a sub-element and the phase difference between the antennas 1 and 2 become the maximum when xS is about 1000 mm and about 2000 mm. At the center frequency of 98 MHz in the FM broadcast band of 88 to 108 MHz in the U.S.A., 1000 mm is equivalent to "$(2/4)\lambda_g$" and 2000 mm is equivalent to "$(4/4)\lambda_g$". That is, the antenna gain in the FM broadcast band (88 to 108 MHz) in the U.S.A. can be improved while ensuring the phase difference between the antennas 1 and 2 by adjusting the length xS so as to become equal to $(2/4)\lambda_g$ or $(4/4)\lambda_g$.

Figure 9A:
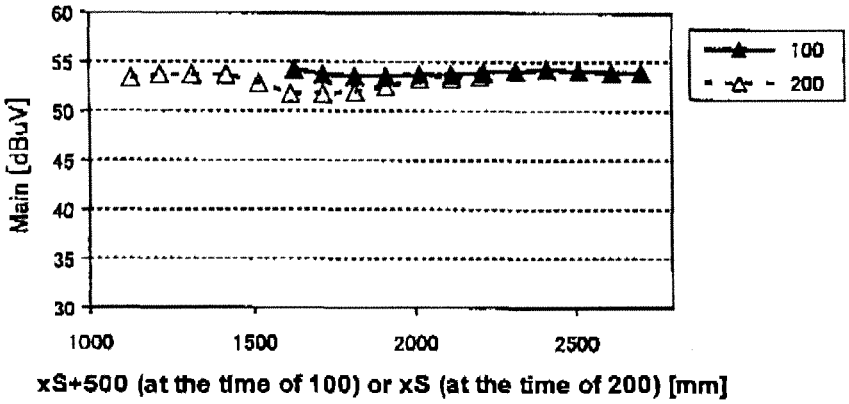
FIGS. 9A to 9C show the measurement data regarding the antenna gain and the phase difference in the glass antenna 200 in which a feeding portion 16 is disposed at the right edge of the window glass 12.
Figure 9B:
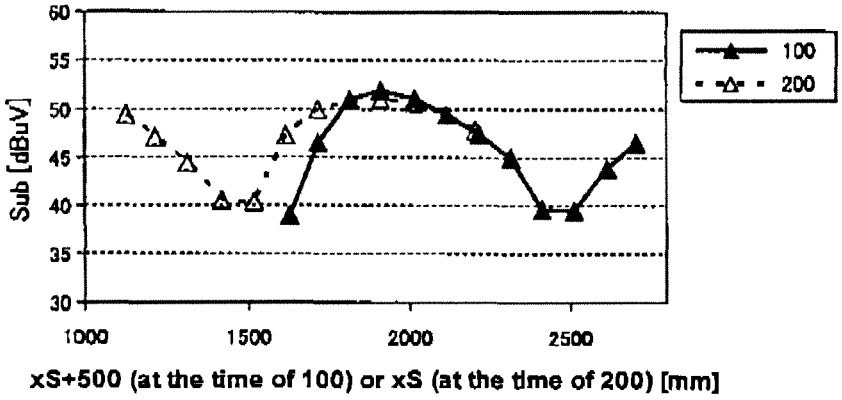
Figure 9C:
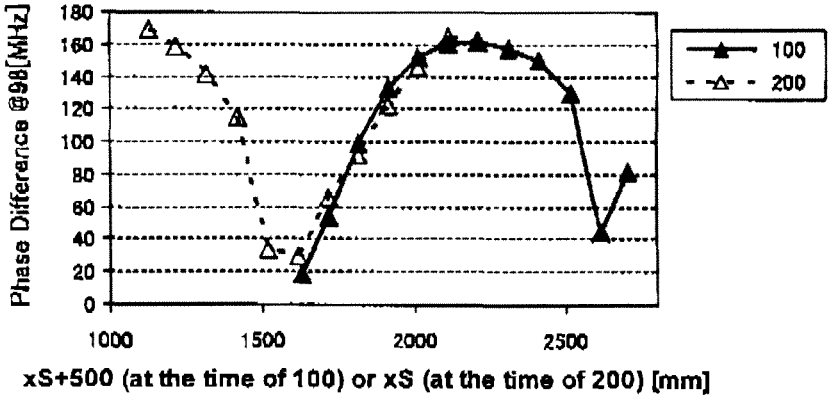
Figure 10A:
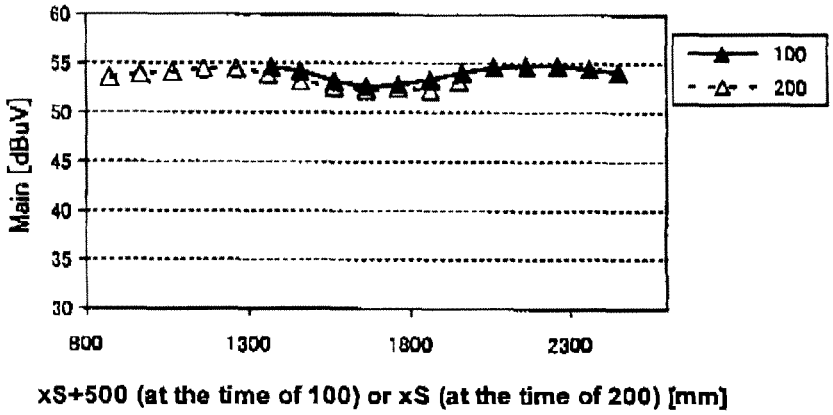
FIGS. 10A to 10C show the measurement data regarding the antenna gain and the phase difference in the glass antenna 200 in which the feeding portion 16 is disposed at a position separated by 300 mm rightward from a centerline 40.
Figure 10B:
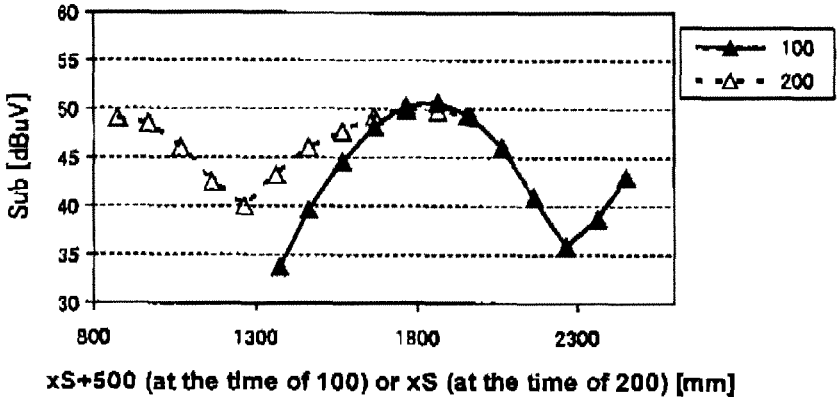
Figure 10C:
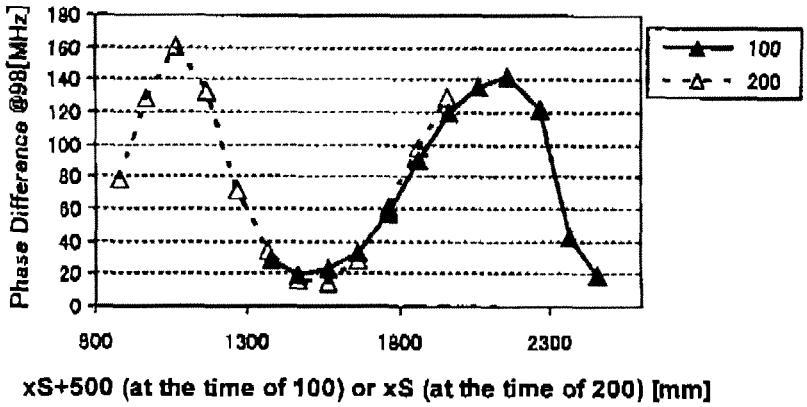
Figure 11A:
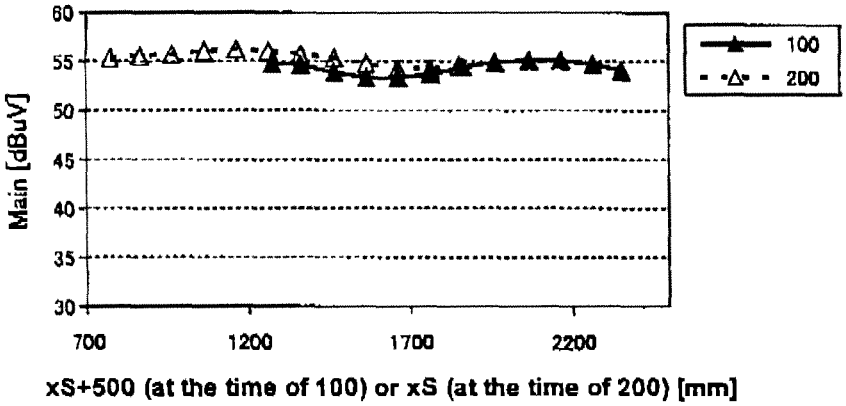
FIGS. 11A to 11C show the measurement data regarding the antenna gain and the phase difference in the glass antenna 200 in which the feeding portion 16 is disposed at a position separated by 200 mm rightward from the centerline 40.
Figure 11B:
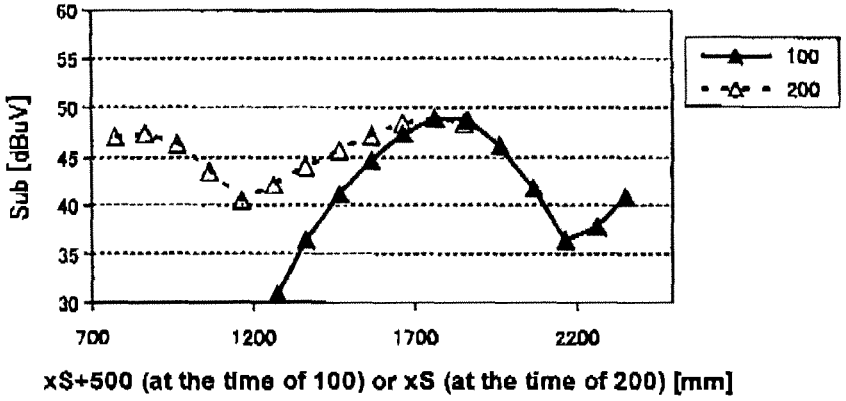
Figure 11C:
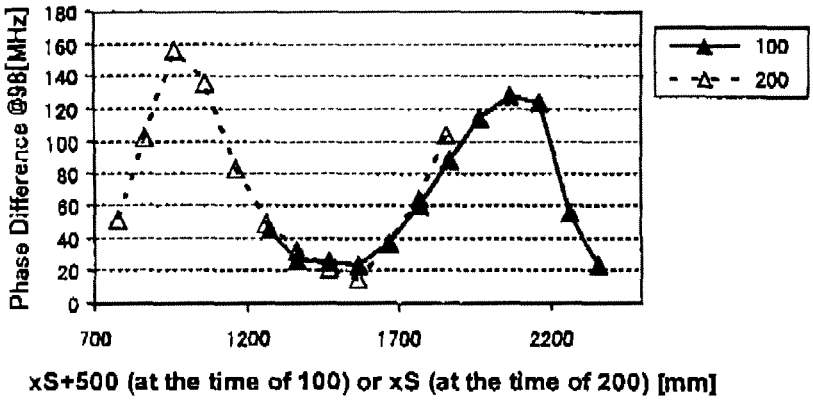

FIGS. 9A to 9C, 10A to 10C, and 11A to 11C show the measurement data regarding the antenna gains and the phase differences when changing the length xS in high-frequency glass antennas for vehicles manufactured by attaching the glass antenna 100 shown in FIG. 1 and the glass antennas 200A, 200C, and 200D shown in FIG. 4 to rear window of an actual vehicle. FIGS. 9A to 9C show the measurement data which compares the glass antenna 100 with the glass antenna 200A when the shortest distance L is 520 mm. FIGS. 10A to 10C show the measurement data which compares the glass antenna 100 with the glass antenna 200C when the shortest distance L is 3000 mm. FIGS. 11A to 11C show the measurement data which compares the glass antenna 100 with the glass antenna 200D when the shortest distance L is 200 mm. Measuring conditions and meaning of the vertical axis are the same as those in FIGS. 6A and 6B. In the case of the glass antenna 100, however, a value obtained by adding 500 mm to xS is shown on the horizontal axis.

According to FIGS. 9A to 9C, 10A to 10C, and 11A to 11C, a waveform of the phase difference of the glass antenna 100 and the antenna gain of the antenna conductor 2 almost overlaps a waveform of the phase difference of the glass antenna 200 and the antenna gain of the antenna conductor 2 if 500 mm is added to xS of the glass antenna 100. 500 mm is equivalent to "$(1/4)\lambda_g$" at the center frequency of 98 MHz in the FM broadcast band of 88 to 108 MHz in the U.S.A.

That is, in the case of the glass antenna 100 in which the defogger 30 is not connected to the antenna conductor 2, the antenna gain in the FM broadcast band (88 to 108 MHz) in the U.S.A. can be improved while ensuring the phase difference between the antennas 1 and 2 by adjusting the conductor length xS from the feeding portion 16B to the end 4*cg* so as to become equal to $(3/4)\lambda_g$.

That is, the antenna gain in the FM broadcast band (88 to 108 MHz) in the U.S.A. can be improved while ensuring the phase difference between the antennas 1 and 2 by adjusting the conductor length xS from the feeding portion 16B to the end 4*cg* to fall within a range obtained by substituting "n=1" into "$\{(1/4)\cdot(2n+1)-(8/64)\}\lambda_g$ or more and $\{(1/4)\cdot(2n+1)+(15/64)\}\lambda_g$ or less" if the shortest distance L is equal to or larger than 350 mm, adjusting the conductor length xS from the feeding portion 16B to the end 4*cg* to fall within a range obtained by substituting "n=1" into "$\{(1/4)\cdot(2n+1)-(8/64)\}\lambda_g$ or more and $\{(1/4)\cdot(2n+1)+(11/64)\}\lambda_g$ or less" if the shortest distance L is equal to or larger than 250 mm and smaller than 350 mm, and adjusting the conductor length xS from the feeding portion 16B to the end 4*cg* to fall within a range obtained by substituting "n=1" into "$\{(1/4)\cdot(2n+1)-(8/64)\}\lambda_g$ or more and $\{(1/4)\cdot(2n+1)+(9/64)\}\lambda_g$ or less" if the shortest distance L is equal to or larger than 150 mm and smaller than 250 mm.

On the other hand, in the case of the glass antenna 200 in which the defogger 30 is connected, the antenna gain in the FM broadcast band (88 to 108 MHz) in the U.S.A. can be improved while ensuring the phase difference between the antennas 1 and 2 by adjusting the conductor length xS from the feeding portion 16B to the connection point 9*g* so as to become equal to a length (that is, $(2/4)\lambda_g$ or $(4/4)\lambda_g$) obtained by adding the length of $(1/4)\lambda_g$ to xS in the case of the glass antenna 100.

That is, the antenna gain in the FM broadcast band (88 to 108 MHz) in the U.S.A. can be improved while ensuring the phase difference between the antennas 1 and 2 by adjusting the conductor length xS from the feeding portion 16B to the connection point 9*g* to fall within a range obtained by substituting "n=1" or "n=2" into "$\{(1/4)\cdot 2n-(8/64)\}\lambda_g$ or more and $\{(1/4)\cdot 2n+(15/64)\}\lambda_g$ or less" if the shortest distance L is equal to or larger than 350 mm, adjusting the conductor length xS from the feeding portion 16B to the connection point 9*g* to fall within a range obtained by substituting "n=1" or "n=2" into "$\{(1/4)\cdot 2n-(8/64)\}\lambda_g$ or more and $\{(1/4)\cdot 2n+(11/64)\}\lambda_g$ or less" if the shortest distance L is equal to or larger than 250 mm and smaller than 350 mm, and adjusting the conductor length xS from the feeding portion 16B to the connection point 9*g* to fall within a range obtained by substituting "n=1" or "n=2" into "$\{(1/4)\cdot 2n-(8/64)\}\lambda_g$ or more and $\{(1/4)\cdot 2n+(9/64)\}\lambda_g$ or less" if the shortest distance L is equal to or larger than 150 mm and smaller than 250 mm.

What is claimed is:

1. A glass antenna for a vehicle on or in a window glass including a defogger having a plurality of heater wires that run in parallel, the glass antenna comprising:

an antenna conductor;

a first feeding portion; and a second feeding portion adjacent to the first feeding portion, wherein:

the antenna conductor includes a first antenna conductor, which extends clockwise with the first feeding portion as a starting point, and a second antenna conductor, which extends counterclockwise at the outside of the first antenna conductor with the second feeding portion as a starting point; and the second antenna conductor includes a first element extending between the first antenna conductor and the defogger.

2. The glass antenna according to claim 1, wherein the first antenna conductor includes:

a second element, which extends in a first direction approximately parallel to the parallel-running direction of the plurality of heater wires; and a third element which extends clockwise up to an end of the extension of the first antenna conductor, with the second element as a starting point, so as to be folded in a second direction which is an opposite direction to the first direction.

3. The glass antenna according to claim 2, wherein when a wavelength in the air at a center frequency of a desired broadcast frequency band is $\lambda_0$, the shortening coefficient of wavelength by glass is k (where k=0.64), and $\lambda_g=\lambda_0\cdot k$, the conductor length of the third element is equal to or larger than $(12/64)\lambda_g$ and equal to or smaller than $(32/64)\lambda_g$.

4. The glass antenna according to claim 2, wherein the conductor length of the third element is equal to or larger than 350 mm and equal to or smaller than 950 mm.

5. The glass antenna according to claim 1, wherein the first antenna conductor includes at least one extension element which extends in the first direction with the first antenna conductor as a starting point.

6. The glass antenna according to claim 1, wherein the second antenna conductor includes:

a fourth element, which extends with the second feeding portion as a starting point and which extends in the first direction approximately parallel to the parallel-running direction of the plurality of heater wires; and a fifth element, which extends with the fourth element as a starting point and which is bypassed at the first direction side of an element end at the first direction side of the first antenna conductor so as to be connected to the first element.

7. The glass antenna according to claim 1, wherein the second antenna conductor includes a connection element which connects the first element and the defogger to each other.

8. The glass antenna according to claim 7, wherein the length of a conductor path which connects the second feeding portion to an end of the extension of the second antenna conductor through the shortest distance is equal to or larger than 700 mm and equal to or smaller than 1200 mm.

9. The glass antenna according to claim 7, wherein:

a shortest distance from the second feeding portion to a centerline of the defogger or the window glass has a positive value in a case that the position of the second feeding portion is at a right side of the centerline viewed from a direction facing a surface of the window glass;

the shortest distance is equal to or larger than 350 mm; and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot 2n-(8/64)\}\lambda_g$ and equal to or smaller than $\{(1/4)\cdot 2n+(15/64)\}\lambda_g$ (where n is a natural number).

10. The glass antenna according to claim 7, wherein:

a shortest distance from the second feeding portion to a centerline of the defogger or the window glass has a positive value in a case that the position of the second feeding portion is at a right side of the centerline viewed from a direction facing a surface of the window glass;

the shortest distance is equal to or larger than 250 mm and smaller than 350 mm; and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot 2n-(8/64)\}\lambda_g$ and equal to or smaller than $\{(1/4)\cdot 2n+(11/64)\}\lambda_g$ (where n is a natural number).

11. The glass antenna according to claim 7, wherein:

a shortest distance from the second feeding portion to a centerline of the defogger or the window glass has a positive value in a case that the position of the second feeding portion is at a right side of the centerline viewed from a direction facing a surface of the window glass;

the shortest distance is equal to or larger than 150 mm and smaller than 250 mm; and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot 2n-(8/64)\}\lambda_g$ and equal to or smaller than $\{(1/4)\cdot 2n+(9/64)\}\lambda_g$ (where n is a natural number).

12. The glass antenna according to claim 7, wherein:

a shortest distance from the second feeding portion to a centerline of the defogger or the window glass has a negative value in a case that the position of the second feeding portion is at a left side of the centerline viewed from a direction facing a surface of the window glass and has a positive value in a case that the position of the second feeding portion is at a right side of the centerline viewed from a direction facing the surface of the window glass;

the shortest distance is equal to or larger than −150 mm and smaller than 150 mm; and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot 2n-(8/64)\}\lambda_g$ and equal to or smaller than $\{(1/4)\cdot 2n\ (7/64)\}\lambda_g$ (where n is a natural number).

13. Window glass for a vehicle comprising the glass antenna according to claim 7.

14. The glass antenna according to claim 1, wherein:

a shortest distance from the second feeding portion to a centerline of the defogger or the window glass has a positive value in a case that the position of the second feeding portion is at a right side of the centerline viewed from a direction facing a surface of the window glass;

the shortest distance is equal to or larger than 350 mm; and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot(2n+1)-(8/64)\}\lambda_g$ and equal to or smaller than $\{(1/4)\cdot(2n+1)+(15/64)\}\lambda_g$ (where n is a natural number).

15. The glass antenna according to claim 1, wherein:

a shortest distance from the second feeding portion to a centerline of the defogger or the window glass has a positive value in a case that the position of the second feeding portion is at a right side of the centerline viewed from a direction facing a surface of the window glass;

the shortest distance is equal to or larger than 250 mm and smaller than 350 mm; and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot(2n+1)-(8/64)\}\lambda_g$ and equal to or smaller than $\{(1/4)\cdot(2n+1)+(11/64)\}\lambda_g$ (where n is a natural number).

16. The glass antenna according to claim 1, wherein:

a shortest distance from the second feeding portion to a centerline of the defogger or the window glass has a positive value in a case that the position of the second feeding portion is at a right side of the centerline viewed from a direction facing a surface of the window glass;

the shortest distance is equal to or larger than 150 mm and smaller than 250 mm; and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot(2n+1)-(8/64)\}\lambda_g$ and equal to or smaller than $\{(1/4)\cdot(2n+1)+(9/64)\}\lambda_g$ (where n is a natural number).

17. The glass antenna according to claim 1, wherein a shortest distance from the second feeding portion to a centerline of the defogger or the window glass has a negative value in a case that the position of the second feeding portion is at a left side of the centerline viewed from a direction facing a surface of the window glass and has a positive value in a case that the position of the second feeding portion is at a right side of the centerline viewed from a direction facing the surface of the window glass;

the shortest distance is equal to or larger than −150 mm and smaller than 150 mm, and when a wavelength in the air at a center frequency of a desired broadcast frequency band is $\lambda_0$, the shortening coefficient of wavelength by glass is k (where k=0.64), and $\lambda_g=\lambda_0 \cdot k$, the length of a conductor path which connects the second feeding portion to an end of the extension of the second antenna conductor through the shortest distance is equal to or larger than $\{(1/4)\cdot(2n+1)-(8/64)\}\lambda_g$ and equal to or smaller than $\{(1/4)\cdot(2n+1)+(7/64)\}\lambda_g$ (where n is a natural number).

18. The glass antenna according to claim 1, wherein the length of a conductor path which connects the second feeding portion to an end of the extension of the second antenna conductor through the shortest distance is equal to or larger than 1200 mm and equal to or smaller than 1700 mm.

19. Window glass for a vehicle comprising the glass antenna according to claim 1.

* * * * *